US010473099B2

(12) United States Patent
Heck et al.

(10) Patent No.: US 10,473,099 B2
(45) Date of Patent: Nov. 12, 2019

(54) MODULAR PUMP SYSTEM

(71) Applicant: Thomas Magnete GmbH, Herdorf (DE)

(72) Inventors: Mike Heck, Derschen (DE); Axel Muller, Siegen (DE); Michael Muller, Hennef (DE); Thomas Rolland, Gebhardshain (DE); Juergen Schonlau, Daaden (DE); Marc Leinweber, Neunkirchen (DE); Markus Ermert, Burbach (DE); Michael Feckler, Herdorf (DE)

(73) Assignee: Thomas Magnete GmbH, Herdorf (DE)

( * ) Notice: Subject to any disclaimer, the term of this patent is extended or adjusted under 35 U.S.C. 154(b) by 338 days.

(21) Appl. No.: 15/308,578

(22) PCT Filed: Sep. 8, 2015

(86) PCT No.: PCT/EP2015/001808

§ 371 (c)(1),
(2) Date: Nov. 2, 2016

(87) PCT Pub. No.: WO2016/041623

PCT Pub. Date: Mar. 24, 2016

(65) Prior Publication Data

US 2017/0058891 A1 Mar. 2, 2017

(30) Foreign Application Priority Data

Sep. 16, 2014 (DE) ..... 10 2014 013 665

(51) Int. Cl.
*F04B 53/22* (2006.01)
*F04B 17/04* (2006.01)
(Continued)

(52) U.S. Cl.
CPC ..... *F04B 53/22* (2013.01); *F04B 9/02* (2013.01); *F04B 17/044* (2013.01);
(Continued)

(58) Field of Classification Search
CPC .... F04B 7/0053; F04B 39/0016; F04B 41/06; F04B 23/00
(Continued)

(56) References Cited

U.S. PATENT DOCUMENTS 5,577,896 A * 11/1996 Harada ..... B60T 8/4031 417/259
6,109,896 A * 8/2000 Schuller ..... B60T 8/4031 137/519.5
(Continued)

FOREIGN PATENT DOCUMENTS

DE 4035835 A1 5/1992
DE 4328621 A1 3/1995
(Continued)

OTHER PUBLICATIONS

International Search Report (in English and German) and Written Opinion (in German) for PCT/EP2015/001808, dated Feb. 11, 2016; ISA/EP.

*Primary Examiner* — Patrick Hamo
(74) *Attorney, Agent, or Firm* — Harness, Dickey & Pierce, P.L.C.

(57) ABSTRACT

A modular system of reciprocating pumps is to be designed in such a way that any type of said reciprocating pumps can be economically assembled and tested on a flexible assembly device. The magnetic part is a pre-assembled subassembly that can be tested separately and is overmolded with plastic material; the connection point to the pump part has a given connecting contour that allows different types of pump parts of the modular system to be connected; and the pump part is a pre-assembled subassembly that can be tested for the displaced volume thereof. Feed pumps and metering pumps for fuels and aqueous reagents.

14 Claims, 2 Drawing Sheets

Figure 1:
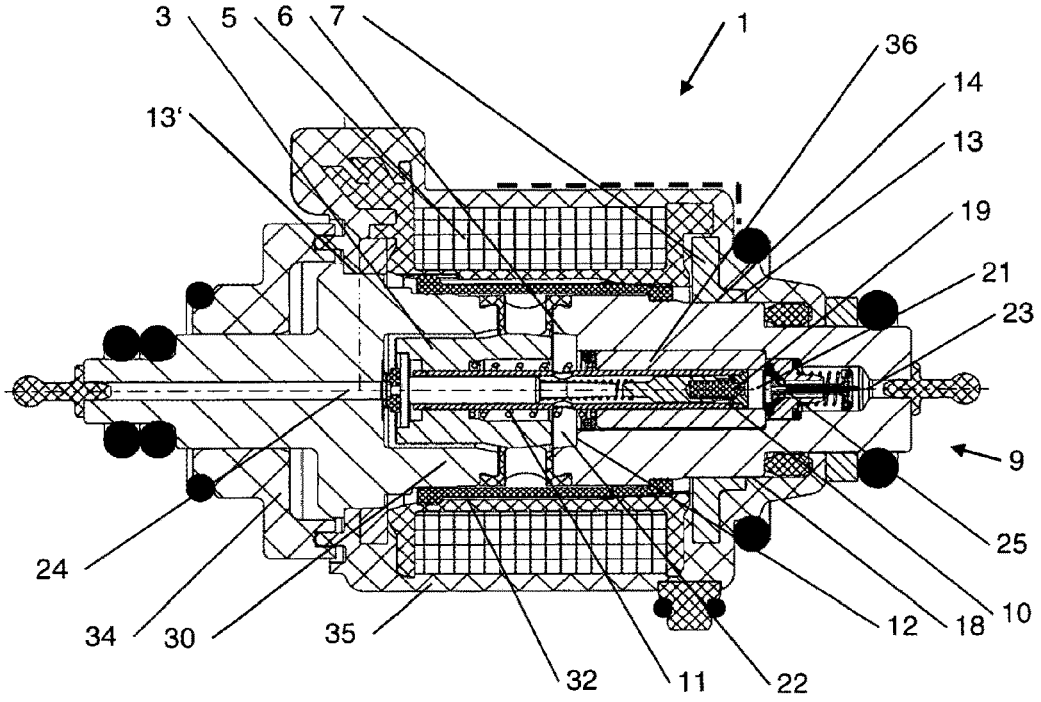

(51) Int. Cl.

| | |
|---|---|
| ***F04B 35/04*** | (2006.01) |
| ***F04B 9/02*** | (2006.01) |
| ***F04B 19/22*** | (2006.01) |
| ***F04B 49/22*** | (2006.01) |
| ***F04B 51/00*** | (2006.01) |

(52) U.S. Cl.
CPC ..... *F04B 17/046* (2013.01); *F04B 17/048* (2013.01); *F04B 19/22* (2013.01); *F04B 35/045* (2013.01); *F04B 49/22* (2013.01); *F04B 51/00* (2013.01)

(58) Field of Classification Search
USPC ..... 417/259
See application file for complete search history.

(56) References Cited

U.S. PATENT DOCUMENTS 6,161,466 A * 12/2000 Schuller ..... B60T 8/4031 417/470
7,690,736 B2 * 4/2010 Kusano ..... B60T 7/042 303/10
7,785,085 B2 * 8/2010 Maeda ..... F04B 1/0421 417/470
7,806,671 B2 * 10/2010 Maeda ..... B60T 8/4031 417/471
8,011,906 B2 * 9/2011 Harada ..... B60T 8/4031 417/254
8,491,287 B2 * 7/2013 Murai ..... B60T 8/4031 417/545
2005/0057103 A1 * 3/2005 Tanimizu ..... H01F 7/081 310/14
2015/0213935 A1 7/2015 Wernau et al.

FOREIGN PATENT DOCUMENTS

| | | | |
|---|---|---|---|
| DE | 19542914 | A1 | 6/1996 |
| DE | 102005058846 | B4 | 4/2009 |
| DE | 102008055610 | A1 | 5/2010 |
| DE | 102011111938 | B3 | 8/2012 |
| DE | 202013011666 | U1 | 3/2014 |
| DE | 102012024640 | A1 | 6/2014 |
| WO | WO-2014026790 | A1 | 2/2014 |

* cited by examiner

MODULAR PUMP SYSTEM

CROSS-REFERENCE TO RELATED APPLICATIONS

This application is a National Stage of International Application No. PCT/EP2015/001808, filed on Sep. 8, 2015, and published in German as WO 2016/041623 A1 on Mar. 24, 2016. This application claims the priority to German Application No. 10 2014 013 665.5, filed on Sep. 16, 2014. The entire disclosures of the above applications are incorporated herein by reference.

FIELD

The disclosure relates to a modular pump system.

BACKGROUND

This section provides background information related to the present disclosure which is not necessarily prior art.

This modular system is intended to render it possible, by means of few but fundamental common features of the pumps, to produce and to test the pumps in large quantities in a cost-effective manner on a partly or fully automated assembly machine that has limited flexibility. The pumps are reciprocating pumps having an energized electromagnetic drive, said reciprocating pumps being embodied as feed pumps that place small demands on the precision of the quantity being delivered per stroke of the piston or as metering pumps that place high demands on the precision of the quantity being delivered per stroke of the piston.

Reciprocating pumps having an energized electromagnetic drive are known for example from the publication DE 4328621A1. The publication DE 10 2008 055 610 A1 discloses a family of reciprocating pumps and the publication DE 10 2011 111 938 B3 discloses a reciprocating pump having a pump component in cartridge form. The utility patent DE 20 2013 011 666 discloses a reciprocating pump having connecting components that can be plugged in. A modular system for electromagnetically actuated valves is disclosed in the publication DE 10 2005 058 846 B4.

It is not possible to produce the known reciprocating pumps together on an assembly machine that has limited flexibility; high setup costs and considerable downtimes would be incurred if it is necessary to fit the machine for assembling another component. The family of reciprocating pumps in accordance with the publication DE 10 2008 055 610 A1 also does not fulfill the requirements since within this family it is only possible to alter the piston displacement but not the structural shapes.

SUMMARY

This section provides a general summary of the disclosure, and is not a comprehensive disclosure of its full scope or all of its features.

A modular system of reciprocating pumps is to be designed in such a manner that all components of these reciprocating pumps can be assembled and tested in a cost-effective manner on an assembly device that has limited flexibility.

The pumps are connected using two connectors to an intake line and an outlet line.

The pumps comprise the following common features:

The pumps are embodied from two pre-assembled assemblies, pump part and magnetic part that can be tested and attached during the end assembly stage.

The pump part fulfills the actual pump function and includes a part of the magnetic circuit, and also fulfills where appropriate a sealing function for preventing an undesired flow of working fluid from the inlet to the outlet.

The pump part is embodied from the magnetic armature, the pole, the pump piston, the pump cylinder, the non-return spring, a valve between the two displacement chambers, either an outlet valve or an inlet valve, a pole pipe, which supports the magnetic armature, and where required an intermediate ring and a membrane.

The magnetic part includes the magnetic coil, the magnetic flux-conducting support that is embodied from iron, the electrical plug, the injection molding with synthetic material and preferably the intake connection that is formed as one therewith.

Client-specific connecting variants are predominantly achieved in the magnetic part, namely various plug embodiments and where appropriate various embodiments of the intake connection.

Various constructions of the pump function are achieved in the pump part, namely:

The pump has a magnetic armature that has a pushing effect, the valve between the displacement chambers is located in the piston rod, and the second valve is an inlet valve.

The pump has a magnetic armature that has a pushing effect, the valve between the two displacement chambers is a slit valve and the second valve is an outlet valve.

The pump has a magnetic armature that has a pulling effect, the valve between the two displacement chambers is a slit valve and the second valve is an outlet valve.

Naturally, constructions having other combinations of these features are also possible. In order to facilitate the assembly on a flexible assembly device, the geometric interface between the pump part and the magnetic part are also embodied in an identical manner, in particular the cylinder surfaces for receiving the pump part and the stop surface for delimiting the insertion path are standardized, the closing arrangement on the side of the outlet connection is in part standardized by means of a cover. The sealing arrangement of the pump part with respect to the magnetic part is achieved either by means of a pole pipe or by means of a membrane. If a membrane is used, an intermediate ring is also used in order to position the pump cylinder. In addition, standardized O-rings are used on the connection side sealing arrangement. The outlet connection is either part of the cover or part of the pump part that penetrates through the cover.

The intake connection is either part of the magnetic part or part of the pump part that penetrates through the magnetic part.

The modular system in accordance with the disclosure is used in order to assemble different feed pumps and metering pumps for fuels or aqueous reagents on a common assembly machine that has limited flexibility.

DRAWINGS

The drawings described herein are for illustrative purposes only of selected embodiments and not all possible implementations, and are not intended to limit the scope of the present disclosure.

Figure 2:
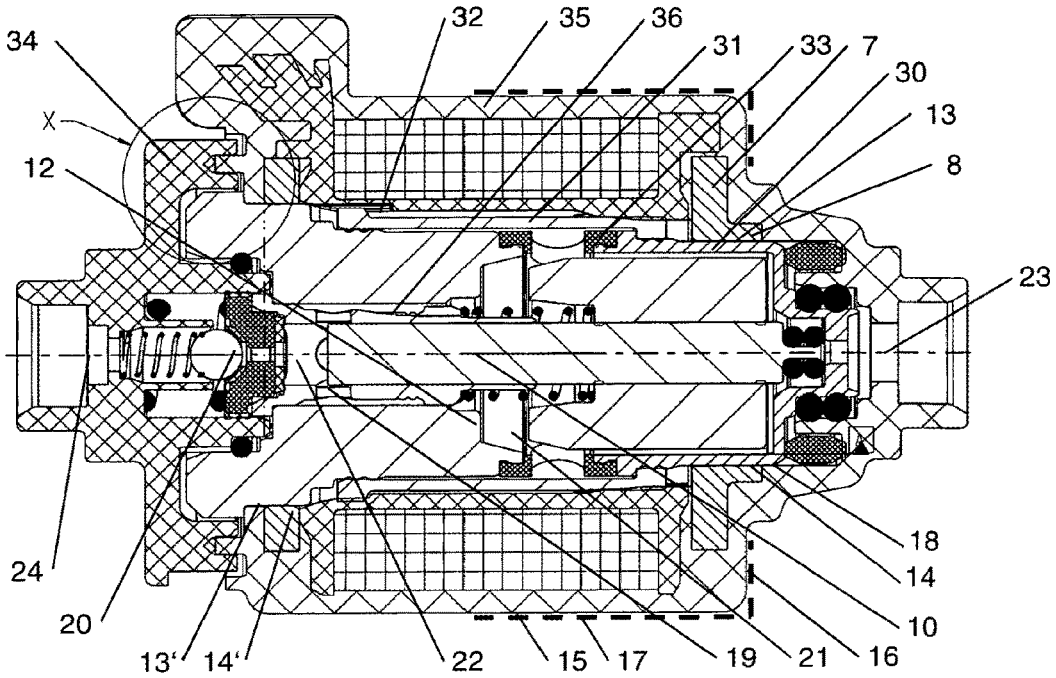
Figure 3:
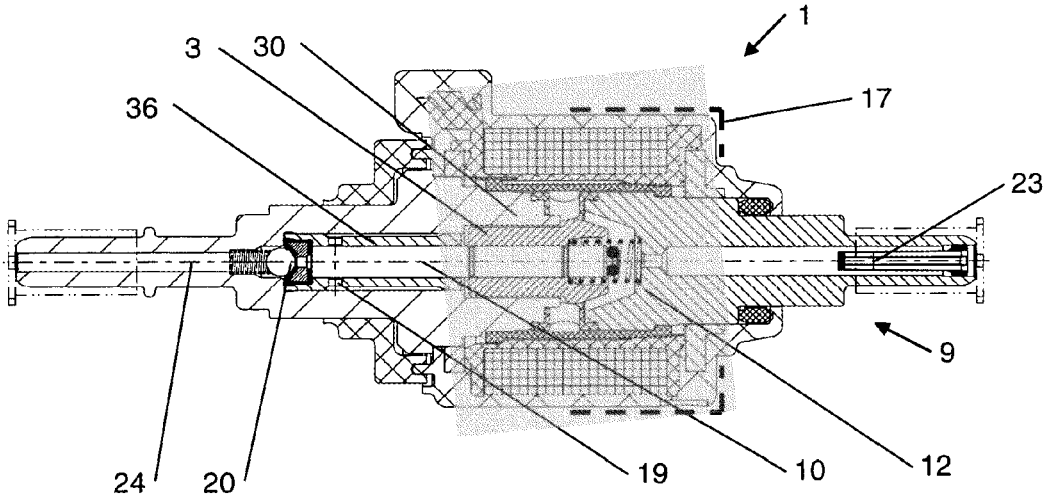

FIG. 1, illustrates a reciprocating pump of the construction I having a pushing magnet, valve in the piston rod and inlet valve as a non-return valve; FIG. 2, illustrates a reciprocating pump of the construction II having a pushing magnetic armature, valve between the displacement chambers as a slit valve and outlet valve as a non-return valve; and FIG. 3, illustrates a reciprocating pump of the construction III having a pulling magnetic armature, valve between the displacement chambers as a slit valve and outlet valve as a non-return valve.

DETAILED DESCRIPTION

Example embodiments will now be described more fully with reference to the accompanying drawings.

The modular pump system includes electromagnetically actuated reciprocating pumps of different constructions (I, II, III), wherein the reciprocating pump comprises a magnetic part (1), a pump part (9), which is connected by way of a connecting site (32) and is arranged predominantly in the interior of the magnetic part (1), and a cover (34).

The magnetic part comprises a magnetic coil (5), a magnetic flux-conducting support (7) and a brace (8), and is injection molded with synthetic material.

The pump part (9) comprises a pole (12) having a control cone (6), a pole pipe (30), an armature (3), a cylinder (36) and a displacement piston (10) that is pushed or pulled by the armature in a longitudinal direction, said displacement piston being returned by a resilient element (11) into the, in each case, other longitudinal direction if the armature is not energized.

The reciprocal movement of the armature (3) is caused by means of a linked magnetic flux that is generated by means of the magnetic coil (5) and is guided by means of the support (7), the brace (8), the pole pipe (30), the armature (3) and the pole (12).

The magnetic part (1) is an assembly that can be pre-assembled and tested whose connecting site (32) to the pump part (9) comprises a predetermined connecting contour with which it is possible to connect pump parts of the modular system for various constructions.

The pump part (9) is an assembly that can be pre-assembled and can be tested with regard to its displacement volume and if it also includes all necessary valves, it can be completely tested.

The magnetic part (1) comprises in the case of all reciprocating pumps of the modular pump system identical or geometrically similar connecting surfaces (15), (16) for receiving the magnetic part in a holding device (17).

The pump part (9) also comprises in the case of all reciprocating pumps of the pump modular system identical or geometrically similar receiving surfaces (18) for receiving the pump component in a not illustrated holding and attaching device (28) whose receiving contour corresponds at least in sections to the inner contour of the magnetic part.

The pump part (9) in a preferred embodiment comprises at least two stepped outer diameters (13), (13') that are identical for all constructions and the magnetic part (1) comprises at least two stepped inner diameters (14), (14') that are tailored to suit said outer diameters.

The pump part (9) is effectively sealed in a predominantly radial direction by means of a pole pipe (30) or by means of a membrane (31), wherein the pole pipe also has the function of receiving the pole (12) and guiding the armature (3). If a membrane (31) is used, an intermediate ring (33) assumes the function of receiving the pole and produces the connection to the pole pipe.

The magnetic part (1) is closed by means of a cover (34) that also holds the pump part (9) in an axial direction in a secure manner and preferably includes a connection of the outlet, wherein the cover (34) is embodied from synthetic material and is connected in a materially-bonded manner to a synthetic material injection molding (35) of the magnetic part (1), preferably by means of welding.

The pump part (9) of the modular pump system comprises a first control valve (19) and preferably a second control valve (20) or (25) that are controlled by the fluid flow that is conveyed and/or the displacement piston (10) of the pump part, wherein the first control valve (19) connects a first displacement chamber (21) to a second displacement chamber (22). If the second control valve (20) or (25) is not part of the assembly pump part, said second control valve is arranged in the magnetic part (1) or in the cover (34).

The pump part (9) of the modular pump system comprises in a construction (II) or a construction (III) in accordance with the drawings in FIG. 2 and FIG. 3 a control valve (20) that connects the second displacement chamber (22) to an outlet (24) of the reciprocating pump.

The pump part (9) of the modular pump system comprises in a construction (I) in accordance with the drawing FIG. 1 a control valve (25) that connects an inlet (23) to the first displacement chamber (21).

The pump part of the modular pump system comprises in a construction (II) in accordance with the drawing FIG. 2 or in a construction (III) in accordance with the drawing FIG. 3 a control valve (19) that is controlled as a type of a slit valve by the displacement piston (10).

The pump part of the modular pump system comprises in one construction (I) in accordance with the drawing FIG. 1 a control valve that is arranged in the displacement piston (10) and is controlled as a non-return valve by the fluid flow that is conveyed.

The armature (3) of the modular pump system in the construction (I) in accordance with the drawing FIG. 1 or in the construction (II) in accordance with the drawing FIG. 2 influences the displacement piston (10) in a pushing manner in the case of the magnetic coil (5) being energized, wherein in the construction (II) the pole (12) of the magnetic part (1) is arranged on the outlet side of the armature (3).

The armature (3) of the modular pump system in the construction (III) in accordance with the drawing FIG. 3 influences the displacement piston (10) in a pulling manner in the case of the magnetic coil (5) being energized, wherein the pole (12) of the magnetic part (1) is arranged on the inlet side of the armature (3).

In the construction (I) of the modular pump system in accordance with the drawing FIG. 1, when the armature (3) is in a resting position in the case of the magnetic coil (5) not being energized, an undesired flow, in other words a flow of working fluid from the inlet (23) to the outlet (24) that is not permissible when the armature is at a standstill, is prevented because the armature is pushed in a sealing manner in the resting position by a resilient element (11) by means of the seal (26) against the outlet-side planar surface (29), wherein the sealing effect is further increased by means of a pressure at the inlet and by means of associated inlet-side effective surfaces on the armature and the displacement piston if the inlet-side pressure is greater than the outlet-side pressure.

In the construction (III) in accordance with the drawing FIG. 3, an undesired flow is prevented when the armature (3) is in a resting position in the case of the magnetic coil (5) not being energized because the displacement piston (10) is pushed by means of a seal (27) in a sealing manner against the outlet when the resilient element (11) is in the resting position, wherein the sealing effect is further increased by means of a pressure at the inlet (23) and by means of associated inlet-side effective surfaces on the armature and the displacement piston if the inlet-side pressure is greater than the outlet-side pressure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

| List of reference numerals | |
|---|---|
| 1. | Magnetic part |
| 3. | Armature |
| 4. | Actuating element |
| 5. | Magnetic coil |
| 6. | Control cone |
| 7. | Support |
| 8. | Brace |
| 9. | Pump part |
| 10. | Displacement piston |
| 11. | Resilient element |
| 12. | Pole |
| 13. | Outer diameter |
| 14. | Inner diameter |
| 15. | Connecting surface |
| 16. | Connecting surface |
| 17. | Holding device |
| 18. | Receiving surface |
| 19. | Control valve |
| 20. | Control valve |
| 21. | Displacement chamber |
| 22. | Displacement chamber |
| 23. | Inlet |
| 24. | Outlet |
| 25. | Control valve |
| 26. | Seal |
| 27. | Seal |
| 28. | Holding and attaching device, not illustrated |
| 29. | Planar surface |
| 30. | Pole pipe |
| 31. | Membrane |
| 32. | Connecting site |
| 33. | Intermediate ring |
| 34. | Cover |
| 35. | Synthetic material injection molding |
| 36. | Cylinder |

The invention claimed is:

1. A modular pump system having a plurality of electromagnetically actuated reciprocating pump configurations, comprising:

the plurality of configurations of the reciprocating pump having a magnetic part and a pump part selected from at least three different pump parts that is predominantly arranged in an interior of the magnetic part, each pump part connected to the magnetic port by way of a connecting site on the magnetic part, and a cover;

the magnetic part having a magnetic coil, a magnetic flux-conducting support and a brace;

each pump part having a pole including a control cone, a pole pipe, an armature, a cylinder and a displacement piston that is pushed or pulled in a longitudinal direction by the armature, said displacement piston being returned into the respective other longitudinal direction by a resilient element, if the armature is not energized;

wherein reciprocating movement of the armature is caused by a linked magnetic flux that is generated by the magnetic coil and is guided by the support, the brace, the pole pipe, the armature, and the pole;

wherein the magnetic part is an assembly that can be pre-assembled and can be tested, said assembly being provided with a synthetic material injection molding;

wherein the connecting site on the magnetic part to each pump part includes a connecting contour that is identical for each pump part, and it is possible using said connecting contour to push each pump part of the modular system into the magnetic part to form each of the plurality of different configurations;

wherein each pump part is an assembly that can be pre-assembled and can be tested at least with regard to its displacement volume;

wherein the magnetic part in the case of all reciprocating pumps of the modular pump system includes identical or geometrically similar connecting surfaces, for receiving the magnetic part in a holding device.

2. The modular pump system as claimed in claim 1, wherein each pump part comprises at least two identical stepped outer diameters, and the magnetic part comprises at least two stepped inner diameters, that are tailored to suit said outer diameters.

3. The modular pump system as claimed in claim 1, wherein each pump part is effectively sealed in a predominantly radial direction by a pole pipe or by a membrane with respect to the magnetic part.

4. The modular pump system as claimed in claim 1 wherein the magnetic part is closed by the cover, wherein the cover is embodied from synthetic material and is connected to the synthetic material injection molding of the magnetic part in a materially-bonded manner.

5. The modular pump system as claimed in claim 1, wherein at least one pump part comprises a first control valve and a second control valve that are controlled by the fluid flow that is conveyed or by the displacement piston of the at least one pump part, wherein the first control valve connects a first displacement chamber to a second displacement chamber.

6. The modular pump system as claimed in claim 1, wherein at least one pump part comprises a control valve that connects a displacement chamber to an outlet of the reciprocating pump.

7. The modular pump system as claimed in claim 1, wherein at least one pump part comprises a control valve that connects an inlet to a first displacement chamber.

8. The modular pump system as claimed in claim 1, wherein at least one pump part comprises a control valve that in the construction type of a slit valve is controlled by the displacement piston.

9. The modular pump system as claimed in claim 1, wherein at least one pump part comprises a control valve that is arranged in the displacement piston and is controlled as a non-return valve by fluid flow that is conveyed.

10. The modular pump system as claimed in claim 1, wherein the armature influences the displacement piston in a pushing manner in the case of the magnetic coil being energized.

11. The modular pump system as claimed in claim 1, wherein the armature influences the displacement piston in a pulling manner in the case of the magnetic coil being energized, wherein the pole of the magnetic part is arranged on an inlet side of the armature.

12. The modular pump system as claimed in claim 1, wherein when the armature is in a resting position, an undesired flow of working fluid from an inlet to an outlet is prevented in the case of the magnetic coil not being energized, wherein the armature in its resting position is pushed by a resilient element by a seal in a sealing manner against an outlet-side planar surface, wherein a sealing effect is further increased by a pressure at the inlet and associated inlet surfaces on the armature and the displacement piston, if an inlet-side pressure is greater than an outlet-side pressure.

13. The modular pump system as claimed in claim 11, wherein when the armature is in a resting position, an undesired flow of working fluid from an inlet to an outlet is prevented in the case of the magnetic coil not being energized, wherein the displacement piston is pushed by the resilient element by a seal in a sealing manner against the outlet, wherein a sealing effect is further increased by a pressure at the inlet and associated inlet-side effective surfaces on the armature and the displacement piston, if an inlet-side pressure is greater than an outlet-side pressure.

14. A modular pump system having a plurality of electromagnetically actuated reciprocating pump configurations, comprising:

a magnetic part having a magnetic coil, a magnetic flux-conducting support, and a brace;

a plurality of different pump parts, each pump part configured to be positioned in an interior of the magnetic part by way of a connecting site on the magnetic part;

each pump part having a pole including a control cone, a pole pipe, an armature, a cylinder, and a displacement piston that is pushed or pulled in a longitudinal direction by the armature, the displacement piston being returned to a respective other longitudinal direction by a resilient element, if the armature is not energized;

wherein reciprocating movement of the armature is caused by a linked magnetic flux generated by the magnetic coil and guided by the support, the brace, the pole pipe, the armature, and the pole;

wherein the magnetic part is an assembly that can be pre-assembled and can be tested, the assembly having an outer molded housing and a cover;

wherein the connecting site on the magnetic part includes a connecting contour that is identical for each pump part such that each pump part is configured to be pushed into the magnetic part to form each of the plurality of electromagnetically actuated reciprocating pump configurations;

wherein each pump part is an assembly that can be pre-assembled and can be tested at least with regard to its displacement volume;

wherein the magnetic part for each of the plurality of electromagnetically actuated reciprocating pump configurations includes identical or geometrically similar connecting surfaces configured to be received in a holding device.

* * * * *